US008024938B2

(12) United States Patent
Rossi et al.

(10) Patent No.: US 8,024,938 B2
(45) Date of Patent: Sep. 27, 2011

(54) METHOD FOR DETERMINING EVAPORATOR AIRFLOW VERIFICATION

(75) Inventors: Todd M. Rossi, Princeton, NJ (US); Keith A. Temple, Langhorne, PA (US); Changlin Sun, Exton, PA (US)

(73) Assignee: Field Diagnostic Services, Inc., Langhorne, PA (US)

( * ) Notice: Subject to any disclaimer, the term of this patent is extended or adjusted under 35 U.S.C. 154(b) by 568 days.

(21) Appl. No.: 11/985,170

(22) Filed: Nov. 14, 2007

(65) Prior Publication Data

US 2008/0196421 A1 Aug. 21, 2008

Related U.S. Application Data

(60) Provisional application No. 60/859,158, filed on Nov. 14, 2006, provisional application No. 60/875,237, filed on Dec. 14, 2006.

(51) Int. Cl.
*F25B 49/00* (2006.01)

(52) U.S. Cl. ..... 62/127; 62/129

(58) Field of Classification Search ..... 62/127, 62/129; 165/11.1
See application file for complete search history.

(56) References Cited

U.S. PATENT DOCUMENTS 4,768,346 A * 9/1988 Mathur ..... 62/127
5,009,076 A * 4/1991 Winslow ..... 62/129
5,044,168 A * 9/1991 Wycoff ..... 62/126
5,481,884 A * 1/1996 Scoccia ..... 62/129
5,586,445 A * 12/1996 Bessler ..... 62/126
6,058,719 A * 5/2000 Cochran ..... 62/129
6,128,910 A * 10/2000 Faircloth ..... 62/129
6,176,095 B1 * 1/2001 Porter ..... 62/126
6,308,523 B1 * 10/2001 Scaringe ..... 62/127
6,571,566 B1 * 6/2003 Temple et al. ..... 62/129
6,701,725 B2 * 3/2004 Rossi et al. ..... 62/125
6,708,508 B2 * 3/2004 Demuth et al. ..... 62/129
6,745,584 B2 6/2004 Pham et al. ..... 62/228.3
6,758,051 B2 7/2004 Jayanth et al. ..... 62/126
6,823,680 B2 11/2004 Jayanth ..... 62/127
6,973,793 B2 * 12/2005 Douglas et al. ..... 62/127
7,032,397 B1 4/2006 Mueller et al. ..... 62/230
7,079,967 B2 * 7/2006 Rossi et al. ..... 702/83
7,100,382 B2 9/2006 Butler et al. ..... 62/126
7,146,819 B2 * 12/2006 Demuth et al. ..... 62/129
7,162,883 B2 1/2007 Jayanth et al. ..... 62/126
7,174,728 B2 2/2007 Jayanth ..... 62/127
7,201,006 B2 * 4/2007 Kates ..... 62/129
7,222,493 B2 5/2007 Jayanth et al. ..... 62/126
7,240,494 B2 7/2007 Akei et al. ..... 62/3.2
7,260,948 B2 8/2007 Jayanth et al. ..... 62/125
7,290,398 B2 11/2007 Wallace et al. ..... 62/157
7,290,989 B2 11/2007 Jayanth ..... 417/44.1
7,296,416 B2 11/2007 Akei et al. ..... 62/3.2
7,296,426 B2 11/2007 Butler et al. ..... 62/181

(Continued)

OTHER PUBLICATIONS

Verified Charge and Airflow Services, Technical Specifications. CSG, 2006. (Attachment 1 of original Specification).

(Continued)

*Primary Examiner* — George Nguyen
(74) *Attorney, Agent, or Firm* — Mark A. Garzia, Esq.; Law Offices of Mark A. Garzia, P.C.

(57) ABSTRACT

A method of providing a field test protocol for determining evaporator airflow verification for existing vapor compression cycle equipment.

15 Claims, 6 Drawing Sheets

Table RD-2, Target Superheat (Suction Line Temperature – Evaporator Saturation Temperature)

| Condenser Air Dry-Bulb Temperature (F) | Return Air Wet-Bulb Temperature (F) | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 |
| 55 | 8.8 | 10.1 | 11.5 | 12.8 | 14.2 | 15.6 | 17.1 | 18.5 | 20 | 21.5 | 23.1 | 24.6 | 26.2 | 27.8 | 29.4 | 31 | 32.4 | 33.8 | 35.1 | 36.4 | 37.7 | 39 | 40.2 | 41.5 | 42.7 | 43.9 | 45.0 |
| 56 | 8.6 | 9.9 | 11.2 | 12.6 | 14 | 15.4 | 16.8 | 18.2 | 19.7 | 21.2 | 22.7 | 24.2 | 25.7 | 27.3 | 28.9 | 30.5 | 31.8 | 33.2 | 34.6 | 35.9 | 37.2 | 38.5 | 39.7 | 41.0 | 42.2 | 43.4 | 44.6 |
| 57 | 8.3 | 9.6 | 11.0 | 12.3 | 13.7 | 15.1 | 16.5 | 17.9 | 19.4 | 20.8 | 22.3 | 23.8 | 25.3 | 26.8 | 28.3 | 29.9 | 31.3 | 32.6 | 34 | 35.3 | 36.7 | 38 | 39.2 | 40.5 | 41.7 | 43.0 | 44.2 |
| 58 | 7.9 | 9.3 | 10.6 | 12.0 | 13.4 | 14.8 | 16.2 | 17.6 | 19.0 | 20.4 | 21.9 | 23.3 | 24.8 | 26.3 | 27.8 | 29.3 | 30.7 | 32.1 | 33.5 | 34.8 | 36.1 | 37.5 | 38.7 | 40.0 | 41.3 | 42.5 | 43.7 |
| 59 | 7.5 | 8.9 | 10.2 | 11.6 | 13.0 | 14.4 | 15.8 | 17.2 | 18.6 | 20.0 | 21.4 | 22.9 | 24.3 | 25.7 | 27.2 | 28.7 | 30.1 | 31.5 | 32.9 | 34.3 | 35.6 | 36.9 | 38.3 | 39.5 | 40.8 | 42.1 | 43.3 |
| 60 | 7.0 | 8.4 | 9.8 | 11.2 | 12.6 | 14.0 | 15.4 | 16.8 | 18.2 | 19.6 | 21.0 | 22.4 | 23.8 | 25.2 | 26.6 | 28.1 | 29.6 | 31.0 | 32.4 | 33.7 | 35.1 | 36.4 | 37.8 | 39.1 | 40.4 | 41.6 | 42.9 |
| 61 | 6.5 | 7.9 | 9.3 | 10.7 | 12.1 | 13.5 | 14.9 | 16.3 | 17.7 | 19.1 | 20.5 | 21.9 | 23.3 | 24.7 | 26.1 | 27.5 | 29.0 | 30.4 | 31.8 | 33.2 | 34.6 | 35.9 | 37.3 | 38.6 | 39.9 | 41.2 | 42.4 |
| 62 | 6.0 | 7.4 | 8.8 | 10.2 | 11.7 | 13.1 | 14.5 | 15.9 | 17.3 | 18.7 | 20.1 | 21.4 | 22.8 | 24.2 | 25.5 | 27.0 | 28.4 | 29.9 | 31.3 | 32.7 | 34.1 | 35.4 | 36.8 | 38.1 | 39.4 | 40.7 | 42.0 |
| 63 | 5.3 | 6.8 | 8.3 | 9.7 | 11.1 | 12.6 | 14.0 | 15.4 | 16.8 | 18.2 | 19.6 | 20.9 | 22.3 | 23.6 | 25.0 | 26.4 | 27.8 | 29.3 | 30.7 | 32.2 | 33.6 | 34.9 | 36.3 | 37.7 | 39.0 | 40.3 | 41.6 |
| 64 | | 6.1 | 7.6 | 9.1 | 10.6 | 12.0 | 13.5 | 14.9 | 16.3 | 17.7 | 19.0 | 20.4 | 21.7 | 23.1 | 24.4 | 25.8 | 27.3 | 28.7 | 30.2 | 31.6 | 33.0 | 34.4 | 35.8 | 37.2 | 38.5 | 39.9 | 41.2 |
| 65 | | 5.4 | 7.0 | 8.5 | 10 | 11.5 | 12.9 | 14.3 | 15.8 | 17.1 | 18.5 | 19.9 | 21.2 | 22.5 | 23.8 | 25.2 | 26.7 | 28.2 | 29.7 | 31.1 | 32.5 | 33.9 | 35.3 | 36.7 | 38.1 | 39.4 | 40.8 |
| 66 | | | 6.3 | 7.8 | 9.3 | 10.8 | 12.3 | 13.8 | 15.2 | 16.6 | 18.0 | 19.3 | 20.7 | 22.0 | 23.2 | 24.6 | 26.1 | 27.6 | 29.1 | 30.6 | 32.0 | 33.4 | 34.9 | 36.3 | 37.6 | 39.0 | 40.4 |
| 67 | | | 5.5 | 7.1 | 8.7 | 10.2 | 11.7 | 13.2 | 14.6 | 16.0 | 17.4 | 18.8 | 20.1 | 21.4 | 22.7 | 24.1 | 25.6 | 27.1 | 28.6 | 30.1 | 31.5 | 33.0 | 34.4 | 35.8 | 37.2 | 38.6 | 39.9 |
| 68 | | | | 6.3 | 8.0 | 9.5 | 11.1 | 12.6 | 14.0 | 15.5 | 16.8 | 18.2 | 19.5 | 20.8 | 22.1 | 23.5 | 25.0 | 26.5 | 28.0 | 29.5 | 31.0 | 32.5 | 33.9 | 35.3 | 36.8 | 38.1 | 39.5 |
| 69 | | | | 5.5 | 7.2 | 8.8 | 10.4 | 11.9 | 13.4 | 14.8 | 16.3 | 17.6 | 19.0 | 20.3 | 21.5 | 22.9 | 24.4 | 26.0 | 27.5 | 29.0 | 30.5 | 32.0 | 33.4 | 34.9 | 36.3 | 37.7 | 39.1 |
| 70 | | | | | 6.4 | 8.1 | 9.7 | 11.2 | 12.7 | 14.2 | 15.7 | 17.0 | 18.4 | 19.7 | 20.9 | 22.3 | 23.9 | 25.4 | 27.0 | 28.5 | 30.0 | 31.5 | 33.0 | 34.4 | 35.9 | 37.3 | 38.7 |
| 71 | | | | | 5.6 | 7.3 | 8.9 | 10.5 | 12.1 | 13.6 | 15.0 | 16.4 | 17.8 | 19.1 | 20.3 | 21.7 | 23.3 | 24.9 | 26.4 | 28.0 | 29.5 | 31.0 | 32.5 | 34.0 | 35.4 | 36.9 | 38.3 |
| 72 | | | | | | 6.4 | 8.1 | 9.8 | 11.4 | 12.9 | 14.4 | 15.8 | 17.2 | 18.5 | 19.7 | 21.2 | 22.8 | 24.3 | 25.9 | 27.4 | 29.0 | 30.5 | 32.0 | 33.5 | 35.0 | 36.5 | 37.9 |
| 73 | | | | | | 5.6 | 7.3 | 9.0 | 10.7 | 12.2 | 13.7 | 15.2 | 16.6 | 17.9 | 19.2 | 20.6 | 22.2 | 23.8 | 25.4 | 26.9 | 28.5 | 30.0 | 31.5 | 33.1 | 34.6 | 36.0 | 37.5 |
| 74 | | | | | | | 6.5 | 8.2 | 9.9 | 11.5 | 13.1 | 14.5 | 15.9 | 17.3 | 18.6 | 20.0 | 21.6 | 23.2 | 24.8 | 26.4 | 28.0 | 29.5 | 31.1 | 32.6 | 34.1 | 35.6 | 37.1 |
| 75 | | | | | | | 5.6 | 7.4 | 9.2 | 10.8 | 12.4 | 13.9 | 15.3 | 16.7 | 18.0 | 19.4 | 21.1 | 22.7 | 24.3 | 25.9 | 27.5 | 29.1 | 30.6 | 32.2 | 33.7 | 35.2 | 36.7 |
| 76 | | | | | | | | 6.6 | 8.4 | 10.1 | 11.7 | 13.2 | 14.7 | 16.1 | 17.4 | 18.9 | 20.5 | 22.1 | 23.8 | 25.4 | 27.0 | 28.6 | 30.1 | 31.7 | 33.3 | 34.8 | 36.3 |
| 77 | | | | | | | | 5.7 | 7.5 | 9.3 | 11.0 | 12.5 | 14.0 | 15.4 | 16.8 | 18.3 | 20.0 | 21.6 | 23.2 | 24.9 | 26.5 | 28.1 | 29.7 | 31.3 | 32.8 | 34.4 | 36.0 |
| 78 | | | | | | | | | 6.7 | 8.5 | 10.2 | 11.8 | 13.4 | 14.8 | 16.2 | 17.7 | 19.4 | 21.1 | 22.7 | 24.4 | 26.0 | 27.6 | 29.2 | 30.8 | 32.4 | 34.0 | 35.6 |
| 79 | | | | | | | | | 5.9 | 7.7 | 9.5 | 11.1 | 12.7 | 14.2 | 15.6 | 17.1 | 18.8 | 20.5 | 22.2 | 23.8 | 25.5 | 27.1 | 28.8 | 30.4 | 32.0 | 33.6 | 35.2 |
| 80 | | | | | | | | | | 6.9 | 8.7 | 10.4 | 12.0 | 13.5 | 15.0 | 16.6 | 18.3 | 20.0 | 21.7 | 23.3 | 25.0 | 26.7 | 28.3 | 29.9 | 31.6 | 33.2 | 34.8 |
| 81 | | | | | | | | | | 6 | 7.9 | 9.7 | 11.3 | 12.9 | 14.5 | 16.0 | 17.7 | 19.4 | 21.1 | 22.8 | 24.5 | 26.2 | 27.9 | 29.5 | 31.2 | 32.8 | 34.4 |
| 82 | | | | | | | | | | 5.2 | 7.1 | 8.9 | 10.6 | 12.2 | 13.7 | 15.4 | 17.2 | 18.9 | 20.6 | 22.3 | 24.0 | 25.7 | 27.4 | 29.1 | 30.7 | 32.4 | 34.0 |
| 83 | | | | | | | | | | | 6.3 | 8.2 | 9.9 | 11.6 | 13.1 | 14.9 | 16.6 | 18.4 | 20.1 | 21.8 | 23.5 | 25.2 | 26.9 | 28.6 | 30.3 | 32.0 | 33.7 |
| 84 | | | | | | | | | | | 5.5 | 7.4 | 9.2 | 10.9 | 12.5 | 14.3 | 16.1 | 17.8 | 19.6 | 21.3 | 23.0 | 24.8 | 26.5 | 28.2 | 29.9 | 31.6 | 33.3 |
| 85 | | | | | | | | | | | | 6.6 | 8.5 | 10.3 | 11.9 | 13.7 | 15.5 | 17.3 | 19 | 20.8 | 22.6 | 24.3 | 26 | 27.8 | 29.5 | 31.2 | 32.9 |
| 86 | | | | | | | | | | | | 5.8 | 7.8 | 9.6 | 11.3 | 13.2 | 15.0 | 16.7 | 18.5 | 20.3 | 22.1 | 23.8 | 25.6 | 27.3 | 29.1 | 30.8 | 32.6 |
| 87 | | | | | | | | | | | | 5.0 | 7.0 | 8.9 | 10.6 | 12.6 | 14.4 | 16.2 | 18.0 | 19.8 | 21.6 | 23.4 | 25.1 | 26.9 | 28.7 | 30.4 | 32.2 |
| 88 | | | | | | | | | | | | | 6.3 | 8.2 | 10.0 | 12.0 | 13.9 | 15.7 | 17.5 | 19.3 | 21.1 | 22.9 | 24.7 | 26.5 | 28.3 | 30.1 | 31.8 |
| 89 | | | | | | | | | | | | | 5.5 | 7.5 | 9.4 | 11.5 | 13.3 | 15.1 | 17.0 | 18.8 | 20.6 | 22.4 | 24.3 | 26.1 | 27.9 | 29.7 | 31.5 |
| 90 | | | | | | | | | | | | | | 6.8 | 8.8 | 10.9 | 12.8 | 14.6 | 16.5 | 18.3 | 20.1 | 22 | 23.8 | 25.6 | 27.5 | 29.3 | 31.1 |

U.S. PATENT DOCUMENTS

| | | | | |
|---|---|---|---|---|
| 7,313,923 | B2 | 1/2008 | Jayanth et al. | 62/126 |
| 7,500,368 | B2 * | 3/2009 | Mowris | 62/149 |
| 7,610,765 | B2 * | 11/2009 | Kang et al. | 62/127 |
| 2003/0019221 | A1 * | 1/2003 | Rossi et al. | 62/127 |
| 2004/0111186 | A1 * | 6/2004 | Rossi et al. | 700/276 |
| 2004/0144106 | A1 * | 7/2004 | Douglas et al. | 62/127 |
| 2005/0126190 | A1 * | 6/2005 | Lifson et al. | 62/129 |
| 2005/0126191 | A1 * | 6/2005 | Lifson et al. | 62/129 |
| 2006/0042276 | A1 * | 3/2006 | Doll et al. | 62/129 |
| 2006/0137370 | A1 * | 6/2006 | Kang et al. | 62/149 |
| 2007/0125102 | A1 * | 6/2007 | Concha et al. | 62/149 |
| 2007/0204635 | A1 * | 9/2007 | Tanaka et al. | 62/129 |

OTHER PUBLICATIONS

HVAC Training, Installation & Maintenance Program Technical Specifications. KEMA, Nov. 22, 2006. (Attachment 2 of original Specification).

Title 24 2005 Residential ACM Manual RD-2005, Appendix RD—Procedures for Determining Refrigerant Charge for Split System space cooling systems without Thermostatic Expansion Valves.

Title 24 2005 Residential ACM Manual RE-2005 Appendix RE—Field Verification and Diagnostic Testing of Forced Air System Fan Flow and Air Handler Fan Watt Draw.

Carrier Corporation, 1986. Required Superheat Calculator GT24-01 020-434. Syracuse, N.Y.: Carrier Corporation. Shown on p. 80 of publication: Carrier Corporation, 1994 Charging Procedures for Residential Condensing Units.

Carrier Corporation, 1994. Charging Procedures for Residential Condensing Units 020-122, (pp. 78-89), Syracuse, N.Y.: Carrier Corporation.

* cited by examiner

Table RD-2, Target Superheat (Suction Line Temperature – Evaporator Saturation Temperature)

| Condenser Air Dry-Bulb Temperature (F) | Return Air Wet-Bulb Temperature (F) | | | | | | | | | | | | | | | | | | | | | | | | | | |
|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 |
| 55 | 8.8 | 10.1 | 11.5 | 12.8 | 14.2 | 15.6 | 17.1 | 18.5 | 20 | 21.5 | 23.1 | 24.6 | 26.2 | 27.8 | 29.4 | 31 | 32.4 | 33.8 | 35.1 | 36.4 | 37.7 | 39 | 40.2 | 41.5 | 42.7 | 43.9 | 45.0 |
| 56 | 8.6 | 9.9 | 11.2 | 12.6 | 14 | 15.4 | 16.8 | 18.2 | 19.7 | 21.2 | 22.7 | 24.2 | 25.7 | 27.3 | 28.9 | 30.5 | 31.8 | 33.2 | 34.6 | 35.9 | 37.2 | 38.5 | 39.7 | 41.0 | 42.2 | 43.4 | 44.6 |
| 57 | 8.3 | 9.6 | 11.0 | 12.3 | 13.7 | 15.1 | 16.5 | 17.9 | 19.4 | 20.8 | 22.3 | 23.8 | 25.3 | 26.8 | 28.3 | 29.9 | 31.3 | 32.6 | 34 | 35.3 | 36.7 | 38 | 39.2 | 40.5 | 41.7 | 43.0 | 44.2 |
| 58 | 7.9 | 9.3 | 10.6 | 12.0 | 13.4 | 14.8 | 16.2 | 17.6 | 19.0 | 20.4 | 21.9 | 23.3 | 24.8 | 26.3 | 27.8 | 29.3 | 30.7 | 32.1 | 33.5 | 34.8 | 36.1 | 37.5 | 38.7 | 40.0 | 41.3 | 42.5 | 43.7 |
| 59 | 7.5 | 8.9 | 10.2 | 11.6 | 13.0 | 14.4 | 15.8 | 17.2 | 18.6 | 20.0 | 21.4 | 22.9 | 24.3 | 25.7 | 27.2 | 28.7 | 30.1 | 31.5 | 32.9 | 34.3 | 35.6 | 36.9 | 38.3 | 39.5 | 40.8 | 42.1 | 43.3 |
| 60 | 7.0 | 8.4 | 9.8 | 11.2 | 12.6 | 14.0 | 15.4 | 16.8 | 18.2 | 19.6 | 21.0 | 22.4 | 23.8 | 25.2 | 26.6 | 28.1 | 29.6 | 31.0 | 32.4 | 33.7 | 35.1 | 36.4 | 37.8 | 39.1 | 40.4 | 41.6 | 42.9 |
| 61 | 6.5 | 7.9 | 9.3 | 10.7 | 12.1 | 13.5 | 14.9 | 16.3 | 17.7 | 19.1 | 20.5 | 21.9 | 23.3 | 24.7 | 26.1 | 27.5 | 29.0 | 30.4 | 31.8 | 33.2 | 34.6 | 35.9 | 37.3 | 38.6 | 39.9 | 41.2 | 42.4 |
| 62 | 6.0 | 7.4 | 8.8 | 10.2 | 11.7 | 13.1 | 14.5 | 15.9 | 17.3 | 18.7 | 20.1 | 21.4 | 22.8 | 24.2 | 25.5 | 27.0 | 28.4 | 29.9 | 31.3 | 32.7 | 34.1 | 35.4 | 36.8 | 38.1 | 39.4 | 40.7 | 42.0 |
| 63 | 5.3 | 6.8 | 8.3 | 9.7 | 11.1 | 12.6 | 14.0 | 15.4 | 16.8 | 18.2 | 19.6 | 20.9 | 22.3 | 23.6 | 25.0 | 26.4 | 27.8 | 29.3 | 30.7 | 32.2 | 33.6 | 34.9 | 36.3 | 37.7 | 39.0 | 40.3 | 41.6 |
| 64 | | 6.1 | 7.6 | 9.1 | 10.6 | 12.0 | 13.5 | 14.9 | 16.3 | 17.7 | 19.0 | 20.4 | 21.7 | 23.1 | 24.4 | 25.8 | 27.3 | 28.7 | 30.2 | 31.6 | 33.0 | 34.4 | 35.8 | 37.2 | 38.5 | 39.9 | 41.2 |
| 65 | | 5.4 | 7.0 | 8.5 | 10 | 11.5 | 12.9 | 14.3 | 15.8 | 17.1 | 18.5 | 19.9 | 21.2 | 22.5 | 23.8 | 25.2 | 26.7 | 28.2 | 29.7 | 31.1 | 32.5 | 33.9 | 35.3 | 36.7 | 38.1 | 39.4 | 40.8 |
| 66 | | | 6.3 | 7.8 | 9.3 | 10.8 | 12.3 | 13.8 | 15.2 | 16.6 | 18.0 | 19.3 | 20.7 | 22.0 | 23.2 | 24.6 | 26.1 | 27.6 | 29.1 | 30.6 | 32.0 | 33.4 | 34.9 | 36.3 | 37.6 | 39.0 | 40.4 |
| 67 | | | 5.5 | 7.1 | 8.7 | 10.2 | 11.7 | 13.2 | 14.6 | 16.0 | 17.4 | 18.8 | 20.1 | 21.4 | 22.7 | 24.1 | 25.6 | 27.1 | 28.6 | 30.1 | 31.5 | 33.0 | 34.4 | 35.8 | 37.2 | 38.6 | 39.9 |
| 68 | | | | 6.3 | 8.0 | 9.5 | 11.1 | 12.6 | 14.0 | 15.5 | 16.8 | 18.2 | 19.5 | 20.8 | 22.1 | 23.5 | 25.0 | 26.5 | 28.0 | 29.5 | 31.0 | 32.5 | 33.9 | 35.3 | 36.8 | 38.1 | 39.5 |
| 69 | | | | 5.5 | 7.2 | 8.8 | 10.4 | 11.9 | 13.4 | 14.8 | 16.3 | 17.6 | 19.0 | 20.3 | 21.5 | 22.9 | 24.4 | 26.0 | 27.5 | 29.0 | 30.5 | 32.0 | 33.4 | 34.9 | 36.3 | 37.7 | 39.1 |
| 70 | | | | | 6.4 | 8.1 | 9.7 | 11.2 | 12.7 | 14.2 | 15.7 | 17.0 | 18.4 | 19.7 | 20.9 | 22.3 | 23.9 | 25.4 | 27.0 | 28.5 | 30.0 | 31.5 | 33.0 | 34.4 | 35.9 | 37.3 | 38.7 |
| 71 | | | | | 5.6 | 7.3 | 8.9 | 10.5 | 12.1 | 13.6 | 15.0 | 16.4 | 17.8 | 19.1 | 20.3 | 21.7 | 23.3 | 24.9 | 26.4 | 28.0 | 29.5 | 31.0 | 32.5 | 34.0 | 35.4 | 36.9 | 38.3 |
| 72 | | | | | | 6.4 | 8.1 | 9.8 | 11.4 | 12.9 | 14.4 | 15.8 | 17.2 | 18.5 | 19.7 | 21.2 | 22.8 | 24.3 | 25.9 | 27.4 | 29.0 | 30.5 | 32.0 | 33.5 | 35.0 | 36.5 | 37.9 |
| 73 | | | | | | 5.6 | 7.3 | 9.0 | 10.7 | 12.2 | 13.7 | 15.2 | 16.6 | 17.9 | 19.2 | 20.6 | 22.2 | 23.8 | 25.4 | 26.9 | 28.5 | 30.0 | 31.5 | 33.1 | 34.6 | 36.0 | 37.5 |
| 74 | | | | | | | 6.5 | 8.2 | 9.9 | 11.5 | 13.1 | 14.5 | 15.9 | 17.3 | 18.6 | 20.0 | 21.6 | 23.2 | 24.8 | 26.4 | 28.0 | 29.5 | 31.1 | 32.6 | 34.1 | 35.6 | 37.1 |
| 75 | | | | | | | 5.6 | 7.4 | 9.2 | 10.8 | 12.4 | 13.9 | 15.3 | 16.7 | 18.0 | 19.4 | 21.1 | 22.7 | 24.3 | 25.9 | 27.5 | 29.1 | 30.6 | 32.2 | 33.7 | 35.2 | 36.7 |
| 76 | | | | | | | | 6.6 | 8.4 | 10.1 | 11.7 | 13.2 | 14.7 | 16.1 | 17.4 | 18.9 | 20.5 | 22.1 | 23.8 | 25.4 | 27.0 | 28.6 | 30.1 | 31.7 | 33.3 | 34.8 | 36.3 |
| 77 | | | | | | | | 5.7 | 7.5 | 9.3 | 11.0 | 12.5 | 14.0 | 15.4 | 16.8 | 18.3 | 20.0 | 21.6 | 23.2 | 24.9 | 26.5 | 28.1 | 29.7 | 31.3 | 32.8 | 34.4 | 36.0 |
| 78 | | | | | | | | | 6.7 | 8.5 | 10.2 | 11.8 | 13.4 | 14.8 | 16.2 | 17.7 | 19.4 | 21.1 | 22.7 | 24.4 | 26.0 | 27.6 | 29.2 | 30.8 | 32.4 | 34.0 | 35.6 |
| 79 | | | | | | | | | 5.9 | 7.7 | 9.5 | 11.1 | 12.7 | 14.2 | 15.6 | 17.1 | 18.8 | 20.5 | 22.2 | 23.8 | 25.5 | 27.1 | 28.8 | 30.4 | 32.0 | 33.6 | 35.2 |
| 80 | | | | | | | | | | 6.9 | 8.7 | 10.4 | 12.0 | 13.5 | 15.0 | 16.6 | 18.3 | 20.0 | 21.7 | 23.3 | 25.0 | 26.7 | 28.3 | 29.9 | 31.6 | 33.2 | 34.8 |
| 81 | | | | | | | | | | 6 | 7.9 | 9.7 | 11.3 | 12.9 | 14.3 | 16.0 | 17.7 | 19.4 | 21.1 | 22.8 | 24.5 | 26.2 | 27.9 | 29.5 | 31.2 | 32.8 | 34.4 |
| 82 | | | | | | | | | | 5.2 | 7.1 | 8.9 | 10.6 | 12.2 | 13.7 | 15.4 | 17.2 | 18.9 | 20.6 | 22.3 | 24..0 | 25.7 | 27.4 | 29.1 | 30.7 | 32.4 | 34.0 |
| 83 | | | | | | | | | | | 6.3 | 8.2 | 9.9 | 11.6 | 13.1 | 14.9 | 16.6 | 18.4 | 20.1 | 21.8 | 23.5 | 25.2 | 26.9 | 28.6 | 30.3 | 32.0 | 33.7 |
| 84 | | | | | | | | | | | 5.5 | 7.4 | 9.2 | 10.9 | 12.5 | 14.3 | 16.1 | 17.8 | 19.6 | 21.3 | 23.0 | 24.8 | 26.5 | 28.2 | 29.9 | 31.6 | 33.3 |
| 85 | | | | | | | | | | | | 6.6 | 8.5 | 10.3 | 11.9 | 13.7 | 15.5 | 17.3 | 19 | 20.8 | 22.6 | 24.3 | 26 | 27.8 | 29.5 | 31.2 | 32.9 |
| 86 | | | | | | | | | | | | 5.8 | 7.8 | 9.6 | 11.3 | 13.2 | 15.0 | 16.7 | 18.5 | 20.3 | 22.1 | 23.8 | 25.6 | 27.3 | 29.1 | 30.8 | 32.6 |
| 87 | | | | | | | | | | | | 5.0 | 7.0 | 8.9 | 10.6 | 12.6 | 14.4 | 16.2 | 18.0 | 19.8 | 21.6 | 23.4 | 25.1 | 26.9 | 28.7 | 30.4 | 32.2 |
| 88 | | | | | | | | | | | | | 6.3 | 8.2 | 10.0 | 12.0 | 13.9 | 15.7 | 17.5 | 19.3 | 21.1 | 22.9 | 24.7 | 26.5 | 28.3 | 30.1 | 31.8 |
| 89 | | | | | | | | | | | | | 5.5 | 7.5 | 9.4 | 11.5 | 13.3 | 15.1 | 17.0 | 18.8 | 20.6 | 22.4 | 24.3 | 26.1 | 27.9 | 29.7 | 31.5 |
| 90 | | | | | | | | | | | | | | 6.8 | 8.8 | 10.9 | 12.8 | 14.6 | 16.5 | 18.3 | 20.1 | 22 | 23.8 | 25.6 | 27.5 | 29.3 | 31.1 |

FIGURE 1A

Table RD-2, Target Superheat (Suction Line Temperature – Evaporator Saturation Temperature)

| Condenser Air Dry-Bulb Temperature (F) | Return Air Wet-Bulb Temperature (F) | | | | | | | | | | | | | | | | | | | | | | | | | | |
|---|---|---|---|---|---|---|---|---|---|---|---|---|---|---|---|---|---|---|---|---|---|---|---|---|---|---|---|
| | 50 | 51 | 52 | 53 | 54 | 55 | 56 | 57 | 58 | 59 | 60 | 61 | 62 | 63 | 64 | 65 | 66 | 67 | 68 | 69 | 70 | 71 | 72 | 73 | 74 | 75 | 76 |
| 91 | | | | | | | | | | | | | | 6.1 | 8.1 | 10.3 | 12.2 | 14.1 | 15.9 | 17.8 | 19.7 | 21.5 | 23.4 | 25.2 | 27.1 | 28.9 | 30.8 |
| 92 | | | | | | | | | | | | | | 5.4 | 7.5 | 9.8 | 11.7 | 13.5 | 15.4 | 17.3 | 19.2 | 21.1 | 22.9 | 24.8 | 26.7 | 28.5 | 30.4 |
| 93 | | | | | | | | | | | | | | | 6.8 | 9.2 | 11.1 | 13.0 | 14.9 | 16.8 | 18.7 | 20.6 | 22.5 | 24.4 | 26.3 | 28.2 | 30.1 |
| 94 | | | | | | | | | | | | | | | 6.2 | 8.7 | 10.6 | 12.5 | 14.4 | 16.3 | 18.2 | 20.2 | 22.1 | 24.0 | 25.9 | 27.8 | 29.7 |
| 95 | | | | | | | | | | | | | | | 5.6 | 8.1 | 10.0 | 12.0 | 13.9 | 15.8 | 17.8 | 19.7 | 21.6 | 23.6 | 25.5 | 27.4 | 29.4 |
| 96 | | | | | | | | | | | | | | | | 7.5 | 9.5 | 11.4 | 13.4 | 15.3 | 17.3 | 19.2 | 21.2 | 23.2 | 25.1 | 27.1 | 29 |
| 97 | | | | | | | | | | | | | | | | 7.0 | 8.9 | 10.9 | 12.9 | 14.9 | 16.8 | 18.8 | 20.8 | 22.7 | 24.7 | 26.7 | 28.7 |
| 98 | | | | | | | | | | | | | | | | 6.4 | 8.4 | 10.4 | 12.4 | 14.4 | 16.4 | 18.3 | 20.3 | 22.3 | 24.3 | 26.3 | 28.3 |
| 99 | | | | | | | | | | | | | | | | 5.8 | 7.9 | 9.9 | 11.9 | 13.9 | 15.9 | 17.9 | 19.9 | 21.9 | 24.0 | 26.0 | 28.0 |
| 100 | | | | | | | | | | | | | | | | 5.3 | 7.3 | 9.3 | 11.4 | 13.4 | 15.4 | 17.5 | 19.5 | 21.5 | 23.6 | 25.6 | 27.7 |
| 101 | | | | | | | | | | | | | | | | | 6.8 | 8.8 | 10.9 | 12.9 | 15.0 | 17.0 | 19.1 | 21.1 | 23.2 | 25.3 | 27.3 |
| 102 | | | | | | | | | | | | | | | | | 6.2 | 8.3 | 10.4 | 12.4 | 14.5 | 16.6 | 18.6 | 20.7 | 22.8 | 24.9 | 27.0 |
| 103 | | | | | | | | | | | | | | | | | 5.7 | 7.8 | 9.9 | 11.9 | 14.0 | 16.1 | 18.2 | 20.3 | 22.4 | 24.5 | 26.7 |
| 104 | | | | | | | | | | | | | | | | | 5.2 | 7.2 | 9.3 | 11.5 | 13.6 | 15.7 | 17.8 | 19.9 | 22.1 | 24.2 | 26.3 |
| 105 | | | | | | | | | | | | | | | | | | 6.7 | 8.8 | 11.0 | 13.1 | 15.2 | 17.4 | 19.5 | 21.7 | 23.8 | 26.0 |
| 106 | | | | | | | | | | | | | | | | | | 6.2 | 8.3 | 10.5 | 12.6 | 14.8 | 17.0 | 19.1 | 21.3 | 23.5 | 25.7 |
| 107 | | | | | | | | | | | | | | | | | | 5.7 | 7.9 | 10.0 | 12.2 | 14.4 | 16.6 | 18.7 | 21.0 | 23.2 | 25.4 |
| 108 | | | | | | | | | | | | | | | | | | 5.2 | 7.4 | 9.5 | 11.7 | 13.9 | 16.1 | 18.4 | 20.6 | 22.8 | 25.1 |
| 109 | | | | | | | | | | | | | | | | | | | 6.9 | 9.1 | 11.3 | 13.5 | 15.7 | 18.0 | 20.2 | 22.5 | 24.7 |
| 110 | | | | | | | | | | | | | | | | | | | 6.4 | 8.6 | 10.8 | 13.1 | 15.3 | 17.6 | 19.9 | 22.1 | 24.4 |
| 111 | | | | | | | | | | | | | | | | | | | 5.9 | 8.1 | 10.4 | 12.6 | 14.9 | 17.2 | 19.5 | 21.8 | 24.1 |
| 112 | | | | | | | | | | | | | | | | | | | 5.4 | 7.6 | 9.9 | 12.2 | 14.5 | 16.8 | 19.1 | 21.5 | 23.8 |
| 113 | | | | | | | | | | | | | | | | | | | | 7.2 | 9.5 | 11.8 | 14.1 | 16.4 | 18.8 | 21.1 | 23.5 |
| 114 | | | | | | | | | | | | | | | | | | | | 6.7 | 9.0 | 11.4 | 13.7 | 16.1 | 18.4 | 20.8 | 23.2 |
| 115 | | | | | | | | | | | | | | | | | | | | 6.2 | 8.6 | 10.9 | 13.3 | 15.7 | 18.1 | 20.5 | 22.9 |

FIGURE 1B

Table RD-3, Target Temperature Split (Return Dry-Bulb – Supply Dry-Bulb)

| Return Air Dry-Bulb Temperature (F) | Return Air Wet-Bulb Temperature (F) | | | | | | | | | | | | | | | | | | | | | | | | | |
|---|---|---|---|---|---|---|---|---|---|---|---|---|---|---|---|---|---|---|---|---|---|---|---|---|---|---|
| | **50** | **51** | **52** | **53** | **54** | **55** | **56** | **57** | **58** | **59** | **60** | **61** | **62** | **63** | **64** | **65** | **66** | **67** | **68** | **69** | **70** | **71** | **72** | **73** | **74** | **75** | **76** |
| **70** | 20.9 | 20.7 | 20.6 | 20.4 | 20.1 | 19.9 | 19.5 | 19.1 | 18.7 | 18.2 | 17.7 | 17.2 | 16.5 | 15.9 | 15.2 | 14.4 | 13.7 | 12.8 | 11.9 | 11.0 | 10.0 | | | | | | |
| **71** | 21.4 | 21.3 | 21.1 | 20.9 | 20.7 | 20.4 | 20.1 | 19.7 | 19.3 | 18.8 | 18.3 | 17.7 | 17.1 | 16.4 | 15.7 | 15.0 | 14.2 | 13.4 | 12.5 | 11.5 | 10.6 | 9.5 | | | | | |
| **72** | 21.9 | 21.8 | 21.7 | 21.5 | 21.2 | 20.9 | 20.6 | 20.2 | 19.8 | 19.3 | 18.8 | 18.2 | 17.6 | 17.0 | 16.3 | 15.5 | 14.7 | 13.9 | 13.0 | 12.1 | 11.1 | 10.1 | 9.0 | | | | |
| **73** | 22.5 | 22.4 | 22.2 | 22.0 | 21.8 | 21.5 | 21.2 | 20.8 | 20.3 | 19.9 | 19.4 | 18.8 | 18.2 | 17.5 | 16.8 | 16.1 | 15.3 | 14.4 | 13.6 | 12.6 | 11.7 | 10.6 | 9.6 | 8.5 | | | |
| **74** | 23.0 | 22.9 | 22.8 | 22.6 | 22.3 | 22.0 | 21.7 | 21.3 | 20.9 | 20.4 | 19.9 | 19.3 | 18.7 | 18.1 | 17.4 | 16.6 | 15.8 | 15.0 | 14.1 | 13.2 | 12.2 | 11.2 | 10.1 | 9.0 | 7.8 | | |
| **75** | 23.6 | 23.5 | 23.3 | 23.1 | 22.9 | 22.6 | 22.2 | 21.9 | 21.4 | 21.0 | 20.4 | 19.9 | 19.3 | 18.6 | 17.9 | 17.2 | 16.4 | 15.5 | 14.7 | 13.7 | 12.7 | 11.7 | 10.7 | 9.5 | 8.4 | 7.2 | |
| **76** | 24.1 | 24.0 | 23.9 | 23.7 | 23.4 | 23.1 | 22.8 | 22.4 | 22.0 | 21.5 | 21.0 | 20.4 | 19.8 | 19.2 | 18.5 | 17.7 | 16.9 | 16.1 | 15.2 | 14.3 | 13.3 | 12.3 | 11.2 | 10.1 | 8.9 | 7.7 | 6.5 |
| **77** | | 24.6 | 24.4 | 24.2 | 24.0 | 23.7 | 23.3 | 22.9 | 22.5 | 22.0 | 21.5 | 21.0 | 20.4 | 19.7 | 19.0 | 18.3 | 17.5 | 16.6 | 15.7 | 14.8 | 13.8 | 12.8 | 11.7 | 10.6 | 9.5 | 8.3 | 7.0 |
| **78** | | | | 24.7 | 24.5 | 24.2 | 23.9 | 23.5 | 23.1 | 22.6 | 22.1 | 21.5 | 20.9 | 20.2 | 19.5 | 18.8 | 18.0 | 17.2 | 16.3 | 15.4 | 14.4 | 13.4 | 12.3 | 11.2 | 10.0 | 8.8 | 7.6 |
| **79** | | | | | | 24.8 | 24.4 | 24.0 | 23.6 | 23.1 | 22.6 | 22.1 | 21.4 | 20.8 | 20.1 | 19.3 | 18.5 | 17.7 | 16.8 | 15.9 | 14.9 | 13.9 | 12.8 | 11.7 | 10.6 | 9.4 | 8.1 |
| **80** | | | | | | | 25.0 | 24.6 | 24.2 | 23.7 | 23.2 | 22.6 | 22.0 | 21.3 | 20.6 | 19.9 | 19.1 | 18.3 | 17.4 | 16.4 | 15.5 | 14.4 | 13.4 | 12.3 | 11.1 | 9.9 | 8.7 |
| **81** | | | | | | | | 25.1 | 24.7 | 24.2 | 23.7 | 23.1 | 22.5 | 21.9 | 21.2 | 20.4 | 19.6 | 18.8 | 17.9 | 17.0 | 16.0 | 15.0 | 13.9 | 12.8 | 11.7 | 10.4 | 9.2 |
| **82** | | | | | | | | | 25.2 | 24.8 | 24.2 | 23.7 | 23.1 | 22.4 | 21.7 | 21.0 | 20.2 | 19.3 | 18.5 | 17.5 | 16.6 | 15.5 | 14.5 | 13.4 | 12.2 | 11.0 | 9.7 |
| **83** | | | | | | | | | | 25.3 | 24.8 | 24.2 | 23.6 | 23.0 | 22.3 | 21.5 | 20.7 | 19.9 | 19.0 | 18.1 | 17.1 | 16.1 | 15.0 | 13.9 | 12.7 | 11.5 | 10.3 |
| **84** | | | | | | | | | | 25.9 | 25.3 | 24.8 | 24.2 | 23.5 | 22.8 | 22.1 | 21.3 | 20.4 | 19.5 | 18.6 | 17.6 | 16.6 | 15.6 | 14.4 | 13.3 | 12.1 | 10.8 |

FIGURE 2

Table RD-4a, Target Evaporating Temperature, TxV Metering Device

| Return Air Wet-bulb Temperature (F) | Outdoor Air Dry-bulb Temperature (F) | | | | | | |
|---|---|---|---|---|---|---|---|
| | **55** | **65** | **75** | **85** | **95** | **105** | **115** |
| **50** | 28 | 29 | 31 | 32 | 33 | 34 | 35 |
| **51** | 29 | 30 | 32 | 33 | 34 | 35 | 36 |
| **52** | 30 | 31 | 32 | 34 | 35 | 36 | 37 |
| **53** | 31 | 32 | 33 | 35 | 36 | 37 | 38 |
| **54** | 32 | 33 | 34 | 35 | 37 | 38 | 39 |
| **55** | 33 | 34 | 35 | 36 | 38 | 39 | 40 |
| **56** | 34 | 35 | 36 | 37 | 38 | 40 | 41 |
| **57** | 35 | 36 | 37 | 38 | 39 | 41 | 42 |
| **58** | 36 | 37 | 38 | 39 | 40 | 41 | 43 |
| **59** | 37 | 38 | 39 | 40 | 41 | 42 | 44 |
| **60** | 38 | 39 | 40 | 41 | 42 | 43 | 44 |
| **61** | 39 | 40 | 41 | 42 | 43 | 44 | 45 |
| **62** | 40 | 41 | 42 | 43 | 44 | 45 | 46 |
| **63** | 40 | 41 | 43 | 44 | 45 | 46 | 47 |
| **64** | 41 | 42 | 43 | 45 | 46 | 47 | 48 |
| **65** | 42 | 43 | 44 | 45 | 47 | 48 | 49 |
| **66** | 43 | 44 | 45 | 46 | 47 | 49 | 50 |
| **67** | 44 | 45 | 46 | 47 | 48 | 49 | 51 |
| **68** | 45 | 46 | 47 | 48 | 49 | 50 | 52 |
| **69** | 46 | 47 | 48 | 49 | 50 | 51 | 52 |
| **70** | 46 | 47 | 49 | 50 | 51 | 52 | 53 |
| **71** | 47 | 48 | 49 | 51 | 52 | 53 | 54 |
| **72** | 48 | 49 | 50 | 51 | 53 | 54 | 55 |
| **73** | 49 | 50 | 51 | 52 | 53 | 55 | 56 |
| **74** | 50 | 51 | 52 | 53 | 54 | 55 | 57 |
| **75** | 50 | 52 | 53 | 54 | 55 | 56 | 57 |
| **76** | 51 | 52 | 53 | 55 | 56 | 57 | 58 |

FIGURE 3A

Table RD-4b, Target Evaporating Temperature, Non-TxV Metering Device

| Return Air Wet-bulb Temperature (F) | Outdoor Air Dry-bulb Temperature (F) | | | | | | |
|---|---|---|---|---|---|---|---|
| | **55** | **65** | **75** | **85** | **95** | **105** | **115** |
| **50** | 34 | 35 | 36 | 37 | 37 | 37 | 37 |
| **51** | 34 | 35 | 36 | 37 | 38 | 38 | 38 |
| **52** | 35 | 36 | 37 | 38 | 38 | 39 | 39 |
| **53** | 35 | 36 | 37 | 38 | 39 | 39 | 40 |
| **54** | 35 | 36 | 38 | 39 | 40 | 40 | 41 |
| **55** | 35 | 37 | 38 | 39 | 40 | 41 | 41 |
| **56** | 36 | 37 | 39 | 40 | 41 | 42 | 42 |
| **57** | 36 | 38 | 39 | 40 | 41 | 42 | 43 |
| **58** | 36 | 38 | 39 | 41 | 42 | 43 | 44 |
| **59** | 36 | 38 | 40 | 41 | 43 | 44 | 45 |
| **60** | 37 | 39 | 40 | 42 | 43 | 45 | 46 |
| **61** | 37 | 39 | 41 | 42 | 44 | 45 | 46 |
| **62** | 37 | 39 | 41 | 43 | 45 | 46 | 47 |
| **63** | 37 | 40 | 42 | 44 | 45 | 47 | 48 |
| **64** | 38 | 40 | 42 | 44 | 46 | 47 | 49 |
| **65** | 38 | 40 | 43 | 45 | 47 | 48 | 50 |
| **66** | 38 | 41 | 43 | 45 | 47 | 49 | 51 |
| **67** | 38 | 41 | 44 | 46 | 48 | 50 | 51 |
| **68** | 39 | 41 | 44 | 46 | 48 | 50 | 52 |
| **69** | 39 | 42 | 44 | 47 | 49 | 51 | 53 |
| **70** | 39 | 42 | 45 | 47 | 50 | 52 | 54 |
| **71** | 40 | 43 | 45 | 48 | 50 | 53 | 55 |
| **72** | 40 | 43 | 46 | 49 | 51 | 53 | 56 |
| **73** | 40 | 43 | 46 | 49 | 52 | 54 | 56 |
| **74** | 40 | 44 | 47 | 50 | 52 | 55 | 57 |
| **75** | 41 | 44 | 47 | 50 | 53 | 56 | 58 |
| **76** | 41 | 44 | 48 | 51 | 54 | 56 | 59 |

FIGURE 3B

AIRFLOW VERIFICATION

*Measure*

Toutdoor
Treturn
Tauction
Pevaporator
Pcondensor or Pdischarge

*Calculate*

If measured Pdischarge convert to Pcond get Tcond from Pcond + chart

Tcoa = Tcond - Toutdoor

[need Tcoa < 30F for method to work]

get Tevap from Pevap

Actual SuperHeat = Tsuction - Tevap determine Target SuperHeat

DTevap = Actual Tevap - Target Tevap

DTsuperheat = Actual SuperHeat - Target SuperHeat

REFRIGERATION VERIFICATION

*measure*

Toutdoor
Treturn
Tsuction
Pevaporator
Pcondensor or Pdischarge
Tliquid

*Calculate* if measured Pdischarge convert to Pcond get Tcond from Pcond + chart

Tcoa = Tcond - Toutdoor

[need Tcoa < 30F for method to work -or- < 10F over manufacturer's value]

Actual SubCooling = Tcond - Tevap get Tevap from Pevap + chart

Actual SuperHeat = Tsuction - Tevap determine Target Tevap from Treturn & Toutdoor DTevap = Actual Tevap - Target Tevap determine target SuperHeat

CONDENSER EVALUATION

*measure*

Tcondenser
Treturn
Pcondenser or Pdischarge

*Calculate* if measured Pdischarge convert to Pcond

Tcoa = Tcond - Toutdoor determine target value of Tcoa if Tcoa >12F then don't need to correct

EVAPORATOR EVALUATION

*measure*

Toutdoor
Treturn
Tsuction
Pevaporator

*Calculate* get Tevap from Pevap + chart

Actual SuperHeat = Tsuction - Tevap determine Target SuperHeat

Determine Target Tevap from Treturn and Toutdoor

DTevap = Actual Tevap - Target Tevap

DTsh = Actual SuperHeat - Target SuperHeat

FIGURE 4

METHOD FOR DETERMINING EVAPORATOR AIRFLOW VERIFICATION

CROSS-REFERENCE TO RELATED APPLICATIONS

The present application claims the benefit under any applicable U.S. statute, including 35 U.S.C. §119(e), to U.S. Provisional Application No. 60/859,158 filed Nov. 14, 2006, titled METHOD FOR DETERMINING REFRIGERATION AND AIRFLOW VERIFICATION in the name of Todd M. Rossi, Keith A. Temple and Changlin Sun, and to U.S. Provisional Application No. 60/875,237 filed Dec. 14, 2006, titled METHOD FOR EVALUATING REFRIGERATION CYCLE PERFORMANCE in the name of Keith A. Temple, Todd M. Rossi and Changlin Sun.

U.S. Provisional Application No. 60/859,158, filed Nov. 14, 2006, is hereby incorporated by reference as if fully set forth herein.

U.S. Provisional Application No. 60/875,237, filed Dec. 14, 2006, is hereby incorporated by reference as if fully set forth herein.

FIELD OF THE INVENTION

The present invention relates generally to vapor compression cycle equipment (refrigeration and air conditioning equipment) and, more specifically, to a method for providing a field test protocol for refrigeration and airflow verification for existing commercial units.

BACKGROUND OF THE INVENTION

In view of the rising costs of energy and the effects of global warming, it is the goal of certain government agencies and electric service providers to save energy and, in particular, electricity by improving the efficiency of equipment that utilizes electricity. Two active players in this endeavor are the California Energy Commission and the Southern California Edison Company. A program implemented in California and will likely be adopted by other states is the Refrigerant Charge and Airflow Verification Program (RCAVP).

Under the RCAVP, refrigeration systems, including Heating, Ventilation and Air Conditioning (HVAC) Systems in general, have their refrigerant charge and air flow verified and, if necessary, adjusted in order to improve efficiency and save energy. It was found that HVAC systems with TVX (thermostatic expansion valves) were just as likely as non-TVX systems to require adjustment to operate at peak or near-peak efficiency.

Based on studies, it was determined that HVAC technicians do not (or are not trained to) finely tune refrigeration systems upon installation, and that proper charge in refrigeration systems tend to degrade over time. More disturbing was the fact that HVAC technicians did not understand the relationship between refrigerant charge and operating efficiency.

SUMMARY OF THE INVENTION

The present invention describes a method of evaluating the efficiency of condensers and evaporators in vapor compression cycle equipment. The method discloses setting up the refrigeration system, the testing setup, and protocols for the evaluations of both condensers and evaporators. The protocol can be applied to packaged or split systems, air-cooled air conditioning or heat pump systems, constant volume or variable volume indoor fans, and constant speed or variable speed compressors, single or tandem in circuit, including un-loaders.

The present invention also describes a series of calculations to be used in the evaluation, and identifies the point at which corrections will be necessary.

The primary issues the present invention is intended to address, and some relevant background information, are set forth in the following two documents which are attached hereto and labeled Attachment 1 and Attachment 2, respectively.

SCE Program: *Verified Charge and Airflow Services, Technical Specifications*. CSG, 2006.

SDG&E Program: *HVAC Training, Installation & Maintenance Program Technical Specifications*. KEMA, Nov. 22, 2006.

Kindly incorporate by reference, as if fully set forth herein, the following four documents:

Title 24, 2005 Residential ACM Manual RD-2005, Appendix D—Procedures for Determining Refrigerant Charge for Split System space cooling systems without Thermostatic Expansion Valves.

Title 24, 2005 Residential ACM Manual RE-2005, Appendix E—Field Verification and Diagnostic Testing of Forced Air System Fan Flow and Air Handler Fan Watt Draw Carrier Corporation, 1986. Required Superheat Calculator GT24-01 020-434. Syracuse, N.Y.: Carrier Corporation.

Carrier Corporation, 1994. Charging Procedures for Residential Condensing Units 020-122 Syracuse, N.Y.: Carrier Corporation.

Carrier Corporation, 1986. Required Superheat Calculator GT24-01 020-434. Syracuse, N.Y.: Carrier Corporation.

BRIEF DESCRIPTION OF THE DRAWINGS

The accompanying drawings, which are incorporated in and form a part of the specification, illustrate the embodiments of the present invention and, together with the following description, serve to explain the principles of the invention. For the purpose of illustrating the invention, there are shown in the drawings embodiments which are presently preferred, it being understood, however, that the invention is not limited to the specific instrumentality or the precise arrangement of elements or process steps disclosed.

FIG. 1A is the Title 24 ACM RD Table for determining Target Superheat;

FIG. 1B is a continuation of the Table shown in FIG. 1A;

FIG. 2 is the Title 24 ACM RD Table for determining Target Temperature Split;

FIG. 3A is a chart showing Target Evaporating Temperature, TxV Metering Device in accordance with the present invention;

FIG. 3B is a chart showing Target Evaporating Temperature, Non-TxV Metering Device in accordance with the present invention; and FIG. 4 is a chart outlining the basic steps of the method and process according to the present invention.

DETAILED DESCRIPTION OF THE PREFERRED EMBODIMENT

In describing a preferred embodiment of the present invention, specific terminology will be selected for the sake of clarity. However, the invention is not intended to be limited to the specific terms so selected, and it is to be understood that each specific term includes all technical equivalents that operate in a similar manner to accomplish a similar purpose.

1. Objective

The method/process for providing a field test protocol for evaporator airflow verification on existing vapor compression cycle equipment will be disclosed. The primary steps in the subject method are presented in FIG. 4.

Attachment 1 titled VERIFIED CHARGE AND AIRFLOW SERVICES—TECHNICAL SPECIFICATIONS, and Attachment 2 titled HVAC TRAINING, INSTALLATION & MAINTENANCE PROGRAM—TECHNICAL SPECIFICATIONS which form a part of this disclosure provide some of the background for the problems and issues the present method addresses.

2. Approach 2.1. Refrigeration Cycle Verification 2.1.1 Verify each circuit individually using the following Refrigeration Cycle Verification protocol. The procedure is outlined below; refer to the following sections for detailed requirements.

| | |
|---|---|
| 2.1.1.1 | Outdoor air damper closed. |
| 2.1.1.2 | Circuit to be tested shall be operating fully loaded. |
| 2.1.1.3 | Measure refrigeration cycle parameters and driving conditions. Save Pre-Test data for each circuit prior to servicing unit. |
| 2.1.1.4 | Evaluate condensing temperature over ambient and check high limit. Resolve or stop if not satisfied. |
| 2.1.1.5 | Evaluate evaporating temperature and check high and low limits. Resolve or stop if not satisfied. |
| 2.1.1.6 | Verify airflow using one of the approved protocols. |
| 2.1.1.7 | For TxV metering device check superheat limits (resolve or stop if not satisfied), then evaluate charge using subcooling method (pass/fail). |
| 2.1.1.8 | For non-TxV metering device evaluate charge using superheat method (pass/fail). |
| 2.1.1.9 | Save Post-Test data for each circuit after servicing is complete. |

2.2. Airflow Verification 2.2.1 Verify airflow using one of the available protocols.

2.2.2 Preferred approach is to verify airflow for each circuit using the Evaporator Performance Airflow Verification™ protocol, in conjunction with refrigeration cycle verification. The procedure is outlined below; refer to the following sections for detailed requirements.

| | |
|---|---|
| 2.2.2.1 | Outdoor air damper closed. |
| 2.2.2.2 | Circuit to be tested shall be operating fully loaded. |
| 2.2.2.3 | Measure refrigeration cycle parameters and driving conditions. |
| 2.2.2.4 | Evaluate condensing temperature over ambient and check high limit. Resolve or stop if not satisfied. |
| 2.2.2.5 | Evaluate evaporating temperature and superheat. |
| 2.2.2.6 | Check evaporating temperature and superheat based on limits for particular metering device (pass/fail). |

3. Test Setup 3.1 General Requirements for Refrigeration and Airflow Verification 3.1.1 This field protocol applies to the following existing commercial equipment:

| | |
|---|---|
| 3.1.1.1 | Packaged or split system. |
| 3.1.1.2 | Air-cooled air conditioning or heat pump system. |
| 3.1.1.3 | Constant volume or variable volume indoor fan(s). |

-continued

| | |
|---|---|
| 3.1.1.4 | Constant speed or variable speed compressor(s), single or tandem in circuit, including un-loaders. |

3.1.2 This field protocol does not apply to the following equipment:

3.1.2.1 Systems with hot gas bypass control

| | |
|---|---|
| 3.1.3 | Outdoor air damper should be closed and return air damper open (100% return air). When closing the outdoor air damper is not practical, testing may be completed with the outdoor air damper at minimum position with no more than approximately 20% outdoor air. The test configuration shall be documented. |
| 3.1.4 | The indoor fan shall be operating at the nominal cooling airflow rate. |
| 3.1.5 | For tests with one or more refrigeration circuits operating, all condenser fans shall be operating at full speed. |

4. Refrigeration Cycle Verification 4.1. General

| | |
|---|---|
| 4.1.1 | Refrigeration cycle verification must be completed for each independent refrigeration circuit |
| 4.1.2 | All compressors shall be operating fully loaded, for the refrigeration circuit to be tested, for a minimum of fifteen (15) minutes in cooling mode to reach quasi-steady operating conditions. There shall be constant control inputs to fans and compressors. |

4.2. Refrigeration Cycle Verification—Each Circuit

Kindly incorporate by reference, as if fully set forth herein, the following documents:

Title 24 2005 Residential ACM Manual RD-2005, Appendix D—Procedures for Determining Refrigerant Charge for Split System space cooling systems without Thermostatic Expansion Valves Title 24 2005 Residential ACM Manual RE-2005, Appendix E—Field Verification and Diagnostic Testing of Forced Air System Fan Flow and Air Handler Fan Watt Draw Carrier Corporation, 1986. Required Superheat Calculator GT24-01 020-434. Syracuse, N.Y.: Carrier Corporation.

Carrier Corporation, 1994. Charging Procedures for Residential Condensing Units 020-122 Syracuse, N.Y.: Carrier Corporation.

4.2.1 Measurements: The following coincident measurements shall be made, in accordance with section 1.6.5 of Attachment 1, for the assessment of each refrigeration circuit:

| | |
|---|---|
| 4.2.1.1 | Condenser entering air dry-bulb temperature (Toutdoor, db) |
| 4.2.1.2 | Return air wet-bulb temperature (Treturn, wb) |
| 4.2.1.3 | Suction line refrigerant temperature (Tsuction) at compressor suction |
| 4.2.1.4 | Suction line refrigerant pressure (Pevaporator) at compressor suction |
| 4.2.1.5 | Liquid line refrigerant pressure (Pcondenser) at the condenser outlet (preferred) or discharge line refrigerant pressure (Pdischarge) at the compressor outlet |
| 4.2.1.6 | Liquid line refrigerant temperature (Tliquid) at the condenser outlet |

4.2.2 Calculations and Criteria

| | |
|---|---|
| 4.2.2.1 | If measuring discharge pressure instead of liquid line pressure, calculate Pcondenser as Pdischarge minus 15 psi (or OEM specification for condenser pressure drop if available). |
| 4.2.2.2 | Using the liquid line pressure (Pcondenser), determine the condenser saturation temperature (Tcondenser) from the standard refrigerant saturated pressure/temperature chart. |
| 4.2.2.3 | Calculate Condensing temperature over ambient (Tcoa) as the condenser saturation temperature minus the Condenser entering air temperature. Tcoa = Tcondenser − Toutdoor. |
| 4.2.2.4 | The condensing temperature over ambient (Tcoa) must be less than +30° F. for a valid verification test. Alternately, the condensing temperature over ambient (Tcoa) must be less than 10° F. over the manufacturer's recommended value. If the condition is not satisfied, the problem must be resolved before proceeding. Save Pre-Test data, for each circuit, prior to making any adjustments or servicing the unit. |
| 4.2.2.5 | Calculate Actual Subcooling as the condensing temperature minus liquid line temperature. Actual Subcooling = Tcondenser − Tliquid. |
| 4.2.2.6 | Using the suction line pressure (Pevaporator), determine the evaporating (saturation) temperature (Tevaporator) from the standard refrigerant saturated pressure/temperature chart. |
| 4.2.2.7 | Calculate Actual Superheat as the suction line temperature minus the evaporator saturation temperature. Actual Superheat = Tsuction − Tevaporator. |
| 4.2.2.8 | Using the return air wet-bulb temperature (Treturn, wb) and condenser entering air dry-bulb temperature (Toutdoor, db), determine the target evaporating temperature using (a) FIG. 3A - Table RD-4a, (b) FIG. 3B - Table RD-4b, (c) OEM provided equivalent for unit being tested, or (d) alternate method appropriate for unit being tested that considers variation with return air wet-bulb temperature (Treturn, wb) and condenser entering air dry-bulb temperature (Toutdoor, db). If the test conditions are outside the range of FIG. 3A - Table RD-4a and FIG. 3B - Table RD-4b, then the test cannot be used under these conditions. |
| 4.2.2.9 | Calculate the difference (DTevap) between actual evaporating temperature and target evaporating temperature. DTevap = Actual Evaporating Temperature − Target Evaporating Temperature. |
| 4.2.2.10 | The evaporating temperature difference (DTevap) must not be less than −10° F. (minus ten) or greater than +15° F. (plus fifteen) for a valid verification test. If DTevap limits are not satisfied, the problem must be resolved before proceeding. |
| 4.2.2.11 | For a Non-TxV metering device, determine the Target Superheat using FIG. 2 - Table RD-2 (reproduced in Appendix A) or equivalent using the return air wet-bulb temperature (Treturn, wb) and condenser entering air dry-bulb temperature (Toutdoor, db). If the test conditions are outside the range of the table, then the test cannot be used under these conditions. For a TxV metering device, the Target Superheat is 20° F. |
| 4.2.2.12 | Complete airflow verification before continuing with final charge verification. Airflow verification using the Evaporator Performance Airflow Verification ™ method may be completed in conjunction with the preceding elements of the refrigeration cycle verification. |
| 4.2.2.13 | Final charge verification for a Non-TxV metering device: Calculate the difference (DTsh) between actual superheat and target superheat. DTsh = Actual Superheat − Target Superheat. Final charge verification shall be completed using the superheat method described in sections 1.6.3 and 1.6.4 of Attachment 1. |
| 4.2.2.14 | Final charge verification for a TxV metering device: The Actual Superheat must be greater than 5° F. and less than 30° F. for a valid verification test. If the Actual Superheat limits are not satisfied, the problem must be resolved before proceeding. Calculate the difference (DTsc) between actual subcooling and target subcooling. DTsc = Actual Subcooling − Target Subcooling. Final charge verification shall be completed using the subcooling method described in sections 1.6.5 and 1.6.6 of Attachment 1. |
| 4.2.2.15 | Save Post-Test data, for each circuit, after servicing is complete. |

5. Airflow Verification

5.1. General 5.1.1 System airflow shall be verified using one of the following methods.

5.2. Direct Airflow Measurement 5.2.1 The method shall comply with the requirements defined in section 1.6.8 of Attachment 1 (Verified Charge and Airflow Services, Technical Specification).

5.2.2 Direct airflow measurement shall be by one of the following methods:

| | |
|---|---|
| 5.2.2.1 | Diagnostic fan flow using flow grid measurement |
| 5.2.2.2 | Diagnostic fan flow using flow capture hood |
| 5.2.2.3 | Airflow measurement using plenum pressure matching |

5.3. Temperature Split Airflow Verification

| | |
|---|---|
| 5.3.1 | The method shall comply with the requirements defined in section 1.6.7 of Attachment 1 (Verified Charge and Airflow Services, Technical Specification). |
| 5.3.2 | System airflow must be verified for the unit with all circuits |

-continued operating fully loaded for a minimum of 15 minutes in cooling mode. All compressors shall be operating fully loaded and there shall be constant control inputs to fans and compressors.

5.4. Evaporator Performance Airflow Verification™

5.4.1 General:

5.4.1.1 The evaporator performance airflow verification method is designed to provide an efficient check to determine if airflow is above the minimum required for a valid refrigerant charge test. The following steps describe the calculations to perform using measured data. If a system fails, then remedial actions must be taken. This test should be conducted in conjunction with the refrigerant charge test. The test should be repeated after any system servicing, including airflow and charge adjustments.

5.4.1.2 System airflow must be verified using one of the following approaches:

5.4.1.2.1. Verify airflow for the unit with all circuits operating fully loaded for a minimum of 15 minutes in cooling mode. All compressors shall be operating fully loaded and there shall be constant control inputs to fans and compressors.

5.4.1.2.2. Verify airflow for each circuit with all compressors operating fully loaded, for the individual circuit being tested, for a minimum of 15 minutes in cooling mode. There shall be constant control inputs to fans and compressors.

-continued 5.4.2 Measurements; The following coincident measurements shall be made, in accordance with section 1.6.5 of Attachment 1, for the assessment of airflow using this method:

5.4.2.1 Condenser entering air dry-bulb temperature (Toutdoor, db)

5.4.2.2 Return air wet-bulb temperature (Treturn, wb)

5.4.2.3 Suction line refrigerant temperature (Tsuction) at compressor suction 5.4.2.4 Suction line refrigerant pressure (Pevaporator) at compressor suction 5.4.2.5 Liquid line refrigerant pressure (Pcondenser) at the condenser outlet (preferred)or discharge line refrigerant pressure (Pdischarge) at the compressor outlet.

5.4.3 Calculations and Criteria 5.4.3.1 If measuring discharge pressure instead of liquid line pressure, calculate Pcondenser as Pdischarge minus 15 psi (or OEM specification for condenser pressure drop if available).

5.4.3.2 Using the liquid line pressure (Pcondenser), determine the condenser saturation temperature (Tcondenser) from the standard refrigerant saturated pressure/temperature chart.

5.4.3.3 Calculate Condensing temperature over ambient (Tcoa) as the condenser saturation temperature minus the Condenser entering air temperature. Tcoa = Tcondenser − Toutdoor.

5.4.3.4 The condensing temperature over ambient (Tcoa) must be less than +30° F. for a valid airflow verification test.

5.4.3.5 Using the suction line pressure (Pevaporator), determine the evaporating (saturation) temperature (Tevaporator) from the standard refrigerant saturated pressure/temperature chart.

5.4.3.6 Calculate Actual Superheat as the suction line temperature minus the evaporator saturation temperature. Actual Superheat = Tsuction − Tevaporator.

5.4.3.7 For a Non-TxV metering device, determine the Target Superheat using FIGS. 1A and 1B - Table RD-2 or equivalent using the return air wet-bulb temperature (Treturn, wb) and condenser entering air dry-bulb temperature (Toutdoor, db). If the test conditions are outside the range of the table, then the test cannot be used under these conditions. For a TxV metering device, the Target Superheat is 20° F. or the original equipment manufacturer (OEM) recommended value.

5.4.3.8 Using the return air wet-bulb temperature (Treturn, wb) and condenser entering air dry-bulb temperature (Toutdoor, db), determine the target evaporating temperature using (a) FIG. 3A - Table RD-4a, (b) FIG. 3B - Table RD-4b, (c) OEM provided equivalent for unit being tested, or (d) alternate method appropriate for unit being tested that considers variation with return air wet-bulb temperature (Treturn, wb) and condenser entering air dry-bulb temperature (Toutdoor, db). If the test conditions are outside the range of FIG. 3A - Table RD-4a and FIG. 3B - Table RD-4b, then the test cannot be used under these conditions.

5.4.3.9 Calculate the difference (DTevap) between actual evaporating temperature and target evaporating temperature. DTevap = Actual Evaporating Temperature − Target Evaporating Temperature.

5.4.3.10 Calculate the difference (DTsh) between actual superheat and target superheat. DTsh = Actual Superheat − Target Superheat.

5.4.3.11 For TxV metering device, if DTevap is less than −8° F. (e.g., −12° F.) and DTsh is less than +5° F., then indoor airflow is low and the system does not pass the adequate airflow criteria and the airflow shall be increased; otherwise, the test passes. (In TxV units, the valve may close in response to low airflow to control superheat near the goal value. The low limit is set to +5° F. to prevent faults that cause high superheat from being confused with low airflow.)

5.4.3.12 For non-TxV metering device, if DTevap is less than −5° F. and DTsh is less than −8° F., then indoor airflow is low and the system does not pass the adequate airflow criteria, or if DTevap is less than −8° F. and Actual Superheat is less than 5° F., then indoor airflow is low and the system does not pass the adequate airflow criteria and the airflow shall be increased; otherwise, the test passes.

Although this invention has been described and illustrated by reference to specific embodiments, it will be apparent to those skilled in the art that various changes, modifications and equivalents may be made which clearly fall within the scope of this invention. The present invention is intended to be protected broadly within the spirit and scope of the appended claim(s).

We claim:

1. A method of testing a refrigeration system comprising the steps of:

operating a compressor of the circuit to be tested under full load in cooling mode for the refrigeration circuit to be tested;

allowing the compressor for the circuit to be tested to reach at least a quasi-steady operating condition;

measuring the refrigeration cycle parameters;

where the refrigeration cycle parameters include at least the entering air dry-bulb temperature, suction line temperature, suction line pressure, and the return air wet-bulb temperature;

where at least one of the liquid line pressure or the discharge line pressure is measured;

using one measured parameter to determine a condenser saturation temperature;

calculating at least one performance parameter;

determining at least one corresponding target parameter and range from those parameters and ranges specified by said refrigeration system's manufacturer;

comparing at least one performance parameter to the corresponding target parameter and range;

determining whether the performance parameter falls outside the target parameter and range;

where if the performance parameter falls outside the target parameter and range then the refrigeration system is eligible for correction;

where the condenser saturation temperature is determined from the liquid line pressure;

where the performance parameter is condensing temperature over ambient;

where condensing temperature over ambient is calculated from the condenser saturation temperature and the entering air dry-bulb temperature;

where the condensing temperature over ambient is compared to the corresponding target parameter; and where the condensing temperature over ambient must be at least one of less than about +30° F. or less than about 10° F. over the manufacturer's recommended target parameter for a valid verification test.

2. A method of testing a refrigeration system comprising the steps of:

operating a compressor of the circuit to be tested under full load in cooling mode for the refrigeration circuit to be tested;

allowing the compressor for the circuit to be tested to reach at least a quasi-steady operating condition;

measuring the refrigeration cycle parameters;

where the refrigeration cycle parameters include at least the entering air dry-bulb temperature, suction line temperature, suction line pressure, and the return air wet-bulb temperature;

where at least one of the liquid line pressure or the discharge line pressure is measured;

using one measured parameter to determine a condenser saturation temperature;

calculating at least one performance parameter;

determining at least one target parameter and range from those parameters and ranges specified by said refrigeration system's manufacturer;

comparing at least one performance parameter to the corresponding target parameter and range;

determining whether the performance parameter falls outside the target parameter and range;

where if the performance parameter falls outside the target parameter and range then the system is eligible for correction;

where the condenser saturation temperature is determined from the liquid line pressure;

where the performance parameter is condensing temperature over ambient;

where condensing temperature over ambient is calculated from the condenser saturation temperature and the entering air dry-bulb temperature;

where the condensing temperature over ambient is compared to the corresponding target parameter; and where the relation of condensing temperature over ambient to a corresponding target parameter determines a valid verification test.

3. The method of claim 1 where the evaporator saturation temperature is determined from suction line pressure.

4. The method of claim 3 further comprising the steps of:

calculating an actual superheat from the suction line temperature and the evaporator saturation temperature;

determining a target evaporator saturation temperature; and calculating a difference of evaporator saturation temperature from evaporator saturation temperature and a target evaporator saturation temperature.

5. The method of claim 4 further comprising the steps of:

determining a target superheat; and calculating a difference of superheat from the actual superheat and the target superheat.

6. The method of claim 5 further comprising the step of determining whether a TxV metering device or a non-TxV metering device is being tested.

7. The method of claim 6 where the airflow system is being verified.

8. The method of claim 7 further comprising the steps of evaluating the difference of evaporating saturation temperature and the difference of superheat.

9. The method of claim 6 where the refrigeration system is being verified.

10. The method of claim 9 further comprising the steps of:

measuring liquid line temperature;

calculating an actual subcooling by subtracting liquid line temperature from condensing temperature;

determining a target subcooling; and calculating a difference of subcooling from the actual subcooling and the target subcooling.

11. The method of claim 10 further comprising the step of performing at least one of evaluating the difference of superheat limits or evaluating the difference of subcooling.

12. A method for determining airflow verification of a refrigeration unit, the method comprising the steps:

placing the refrigeration unit under full load;

measuring condenser entering air dry-bulb temperature (Toutdoor, db);

measuring return air wet-bulb temperature (Treturn, wb);

measuring suction line refrigerant temperature (Tsuction) at compressor suction;

measuring suction line refrigerant pressure (Pevaporator) at compressor suction;

measuring liquid line refrigerant pressure (Pcondenser) at the condenser outlet;

determining the condenser saturation temperature (Tcondenser) from the standard refrigerant saturated pressure/temperature chart, using the liquid line pressure (Pcondenser);

calculating Condensing temperature over ambient (Tcoa) as the condenser saturation temperature minus the Condenser entering air temperature $$Tcoa=Tcondenser-Toutdoor;$$

checking to ensure the condensing temperature over ambient (Tcoa) is less than +30° F. for a valid airflow verification test;

determining the evaporating (saturation) temperature (Tevaporator) from a standard refrigerant saturated pressure/temperature chart, using the suction line pressure (Pevaporator);

calculating Actual Superheat as the suction line temperature minus the evaporator saturation temperature $$\text{Actual Superheat}=Tsuction-Tevaporator;$$

for a Non-TxV metering device, determining the Target Superheat using FIGS. 1A and 1B—Table RD-2 or equivalent using the return air wet-bulb temperature (Treturn, wb) and condenser air dry-bulb temperature (Toutdoor, db), otherwise, for a TxV metering device, the Target Superheat is 20° F.;

using the return air wet-bulb temperature (Treturn, wb) and condenser air dry-bulb temperature (Toutdoor, db), determine the target evaporating temperature using (a) FIG. 3A—Table RD-4a, (b) FIG. 3B —Table RD-4b, (c) OEM provided equivalent for refrigeration system being tested, or (d) alternate method appropriate for refrigeration system being tested that considers variation with return air wet-bulb temperature (Treturn, wb) and condenser air dry-bulb temperature (Toutdoor, db);

calculating the difference (DTevap) and target evaporating temperature $$DTevap=\text{Actual Evaporating Temperature}-\text{Target Evaporating Temperature};$$

calculate the difference (DTsh) between actual superheat and target superheat $$DTsh=\text{Actual Superheat}-\text{Target Superheat}.$$

13. A method for determining evaporator airflow verification of a refrigeration unit, the method comprising the steps:

a) place the refrigeration unit under full load;

b) measure condenser entering air dry-bulb temperature (Toutdoor, db);

c) measure return air wet-bulb temperature (Treturn, wb);

d) measure suction line refrigerant temperature (Tsuction) at compressor suction;

e) measure suction line refrigerant pressure (Pevaporator) at compressor suction;

f) measure liquid line refrigerant pressure (P condenser) at the condenser outlet;

g) determine the condenser saturation temperature (Tcondenser) from a standard refrigerant saturated pressure/temperature chart, using the liquid line pressure (Pcondenser);

h) calculate Condensing temperature over ambient (Tcoa) as the condenser saturation temperature minus the Condenser entering air temperature $$Tcoa=Tcondenser-Toutdoor;$$

i) check to ensure the condensing temperature over ambient (Tcoa) is less than +30° F. for a valid airflow verification test;

j) determine the evaporating (saturation) temperature (Tevaporator) from the standard refrigerant saturated pressure/temperature chart, using the suction line pressure (Pevaporator);

k) calculate Actual Superheat as the suction line temperature minus the evaporator saturation temperature $$\text{Actual Superheat}=Tsuction-Tevaporator;$$

l) for a Non-TxV metering device, determine the Target Superheat using FIGS. 1A and 1B—Table RD-2 or equivalent using the return air wet-bulb temperature (Treturn, wb) and condenser air dry-bulb temperature (Toutdoor, db), otherwise, for a TxV metering device, the Target Superheat is 20° F. or the original equipment manufacturer (OEM) recommended value;

m) using the return air wet-bulb temperature (Treturn, wb) and condenser air dry-bulb temperature (Toutdoor, db), determine the target evaporating temperature using (a) FIG. 3A—Table RD-4a, (b) FIG. 3B—Table RD-4b, (c) OEM provided equivalent for refrigeration system being tested, or (d) alternate method appropriate for refrigeration system being tested that considers variation with return air wet-bulb temperature (Treturn, wb) and condenser air dry-bulb temperature (Toutdoor, db);

n) calculate the difference (DTevap) between actual evaporating temperature and target evaporating temperature $$DTevap=\text{Actual Evaporating Temperature}-\text{Target Evaporating Temperature};$$

o) calculate the difference (DTsh) between actual superheat and target superheat $$DTsh=\text{Actual Superheat}-\text{Target Superheat};$$

p) compare DTevap to the recommended threshold; and q) compare DTsh to the recommended threshold.

14. A method for determining airflow verification of a refrigeration unit, the method comprising the steps:

placing the refrigeration unit under full load;

measuring condenser entering air dry-bulb temperature (Toutdoor, db);

measuring return air wet-bulb temperature (Treturn, wb);

measuring suction line refrigerant temperature (Tsuction) at compressor suction;

measuring suction line refrigerant pressure (Pevaporator) at compressor suction;

measuring discharge line refrigerant pressure (Pdischarge) at the compressor outlet;

calculating Pcondenser as Pdischarge minus 15 psi;

determining the condenser saturation temperature (Tcondenser) from the standard refrigerant saturated pressure/temperature chart, using the liquid line pressure (Pcondenser);

calculating Condensing temperature over ambient (Tcoa) as the condenser saturation temperature minus the Condenser entering air temperature $$Tcoa=Tcondenser-Toutdoor;$$

checking to ensure the condensing temperature over ambient (Tcoa) is less than +30° F. for a valid airflow verification test;

determining the evaporating (saturation) temperature (Tevaporator) from a standard refrigerant saturated pressure/temperature chart, using the suction line pressure (Pevaporator);

calculating Actual Superheat as the suction line temperature minus the evaporator saturation temperature Actual Superheat=$T$suction−$T$evaporator;

for a Non-TxV metering device, determining the Target Superheat using FIGS. 1A and 1B—Table RD-2 or equivalent using the return air wet-bulb temperature (Treturn, wb) and condenser air dry-bulb temperature (Toutdoor, db), otherwise, for a TxV metering device, the Target Superheat is 20° F.;

using the return air wet-bulb temperature (Treturn, wb) and condenser air dry-bulb temperature (Toutdoor, db), determine the target evaporating temperature using (a) FIG. 3A—Table RD-4a, (b) FIG. 3B—Table RD-4b, (c) OEM provided equivalent for refrigeration system being tested, or (d) alternate method appropriate for refrigeration system being tested that considers variation with return air wet-bulb temperature (Treturn, wb) and condenser air dry-bulb temperature (Toutdoor, db);

calculating the difference (DTevap) and target evaporating temperature $DT$evap=Actual Evaporating Temperature−Target Evaporating Temperature;

calculate the difference (DTsh) between actual superheat and target superheat $DT$sh=Actual Superheat—Target Superheat.

15. A method for determining evaporator airflow verification of a refrigeration unit, the method comprising the steps:

a) place the refrigeration unit under full load;

b) measure condenser entering air dry-bulb temperature (Toutdoor, db);

c) measure return air wet-bulb temperature (Treturn, wb);

d) measure suction line refrigerant temperature (Tsuction) at compressor suction;

e) measure suction line refrigerant pressure (Pevaporator) at compressor suction;

f) measure discharge line refrigerant pressure (Pdischarge) at the compressor outlet;

g) calculate Pcondenser as Pdischarge minus 15 psi;

h) determine the condenser saturation temperature (Tcondenser) from a standard refrigerant saturated pressure/temperature chart, using the liquid line pressure (Pcondenser);

i) calculate Condensing temperature over ambient (Tcoa) as the condenser saturation temperature minus the Condenser entering air temperature $T$coa=$T$condenser−$T$outdoor;

j) check to ensure the condensing temperature over ambient (Tcoa) is less than +30° F. for a valid airflow verification test;

k) determine the evaporating (saturation) temperature (Tevaporator) from the standard refrigerant saturated pressure/temperature chart, using the suction line pressure (Pevaporator);

l) calculate Actual Superheat as the suction line temperature minus the evaporator saturation temperature Actual Superheat=$T$suction−$T$evaporator;

m) for a Non-TxV metering device, determine the Target Superheat using FIGS. 1A and 1B—Table RD-2 or equivalent using the return air wet-bulb temperature (Treturn, wb) and condenser air dry-bulb temperature (Toutdoor, db), otherwise, for a TxV metering device, the Target Superheat is 20° F. or the original equipment manufacturer (OEM) recommended value;

n) using the return air wet-bulb temperature (Treturn, wb) and condenser air dry-bulb temperature (Toutdoor, db), determine the target evaporating temperature using (a) FIG. 3A—Table RD-4a, (b) FIG. 3B—Table RD-4b, (c) OEM provided equivalent for refrigeration system being tested, or (d) alternate method appropriate for refrigeration system being tested that considers variation with return air wet-bulb temperature (Treturn, wb) and condenser air dry-bulb temperature (Toutdoor, db);

o) calculate the difference (DTevap) between actual evaporating temperature and target evaporating temperature $DT$evap=Actual Evaporating Temperature−Target Evaporating Temperature;

p) calculate the difference (DTsh) between actual superheat and target superheat $DT$sh=Actual Superheat−Target Superheat;

q) compare DTevap to the recommended threshold; and r) compare DTsh to the recommended threshold.

* * * * *